US007100642B2

(12) United States Patent
Taboga

(10) Patent No.: US 7,100,642 B2
(45) Date of Patent: Sep. 5, 2006

(54) MACHINE FOR THE FORMATION OF METAL MESH AND RELATIVE METHOD

(75) Inventor: Ermanno Taboga, Buia (IT)

(73) Assignee: Beta Systems SRL, Reana del Rojale (UD) (IT)

( * ) Notice: Subject to any disclaimer, the term of this patent is extended or adjusted under 35 U.S.C. 154(b) by 0 days.

(21) Appl. No.: 10/518,015

(22) PCT Filed: Jun. 17, 2003

(86) PCT No.: PCT/IB03/02331

§ 371 (c)(1),
(2), (4) Date: Dec. 14, 2004

(87) PCT Pub. No.: WO03/106070

PCT Pub. Date: Dec. 24, 2003

(65) Prior Publication Data

US 2005/0247368 A1 Nov. 10, 2005

(30) Foreign Application Priority Data

Jun. 18, 2002 (IT) ..... UD2002A0135

(51) Int. Cl.
*B21F 27/10* (2006.01)

(52) U.S. Cl. ..... 140/7; 140/112

(58) Field of Classification Search ..... 140/5, 140/7, 112; 219/56
See application file for complete search history.

(56) References Cited

U.S. PATENT DOCUMENTS 2,368,047 A * 1/1945 Southwick ..... 140/112
4,539,457 A 9/1985 Pinger et al.
5,013,879 A 5/1991 Lind

FOREIGN PATENT DOCUMENTS

| | | |
|---|---|---|
| EP | 1177851 | 2/2002 |
| JP | 8243763 | 9/1996 |
| WO | 9506532 | 3/1995 |

* cited by examiner

*Primary Examiner*—Lowell A. Larson
(74) *Attorney, Agent, or Firm*—Stevens, Davis, Miller & Mosher, LLP

(57) ABSTRACT

Machine for the formation of a metal mesh obtained by attaching together a plurality of longitudinal metal wires to a plurality of transverse metal wires. The machine includes a first feed assembly to make the longitudinal wires advance step-wise, a second feed assembly to arrange one transverse wire at a time in a first preparation position, a positioning apparatus to arrange the transverse wire in a second attachment position, and a welding assembly to attach the transverse wires to the longitudinal wires. The positioning apparatus includes a loading assembly, provided with a gripping and transfer device, to locate the transverse wire in the second attachment position. The machine also includes a thrusting device to take the transverse wire from the first preparation position to a third intermediate pick-up position, near the second attachment position, wherein the transverse wire is picked up by the gripping and transfer device. The thrusting device includes a rotary element provided with blade able to thrust the transverse wire from the first preparation position to the third intermediate pick-up position.

15 Claims, 7 Drawing Sheets

MACHINE FOR THE FORMATION OF METAL MESH AND RELATIVE METHOD

This application is a §371 National Stage Application of International Application No. PCT/IB03/02331, filed on 17 Jun. 2003, claiming the priority of Italian Patent Application No. UD2002A000135 filed on 18 Jun. 2002.

FIELD OF THE INVENTION

The present invention concerns a machine used for the production of a metal mesh and the relative production method.

The invention is applied preferentially, but not exclusively, to make electro-welded mesh used as metal reinforcement elements for structures made of reinforced concrete.

For this reason, in the following description we shall make specific reference to this application, although the invention can also be used for the formation of other types of mesh.

BACKGROUND OF THE INVENTION

Various machines are known for the production of electro-welded mesh, each one consisting of a plurality of longitudinal metal wires or round pieces, distanced from each other, on which corresponding transverse metal wires or round pieces are welded perpendicularly and according to a predetermined interaxis.

Such machines generally comprise at least an assembly to feed and advance the longitudinal wires, an assembly to feed the transverse wires, means to position the transverse wires in the attachment position and a welding assembly by means of which the longitudinal wires and transverse wires are associated.

The functioning of such machines provides that a transverse wire, in some cases several transverse wires at the same time, is fed and arranged in an attachment position in which it is joined to the longitudinal wires by means of the welding assembly.

Subsequently the longitudinal wires are made to advance simultaneously by a pitch equivalent to the interaxis between the transverse wires, so that a new transverse wire can be fed and arranged in the attachment position.

One of the main limits of such machines is their low productivity, caused by the need to feed the transverse wires at a certain distance from the welding assembly, and then move them to the attachment position by means of the positioning means.

This entails long downtimes due to the traveling time of the transverse wires in the feed step, since the front end of the wires has to pass through the whole width of the machine, and also due to the subsequent movement of the transverse wires to the attachment position.

Some conventional machines, an example of which is shown in U.S. Pat. No. 4,539,457, provide that, while a first transverse wire is moved to the attachment position by the positioning means, a second transverse wire is fed and kept in a preparation position, near the attachment position, waiting to be subsequently taken to the latter.

While such solutions have allowed a partial reduction in downtimes, they have not allowed to reach satisfactory levels of productivity, since the times needed for the positioning means to travel from the attachment position to the preparation position and vice versa are still too long.

The present Applicant has devised and embodied this invention to overcome the shortcomings of the state of the art and to obtain further advantages.

SUMMARY OF THE INVENTION

The present invention is set forth and characterized essentially in the main claims, while the dependent claims describe other innovative characteristics of the invention.

The purpose of the invention is to achieve a machine and a method which will allow to form high productivity metal wire mesh, limiting the downtimes due to the steps of feeding and positioning the transverse wires.

In accordance with this purpose, the machine for the formation of mesh according to the present invention comprises at least a first feed assembly able to make a plurality of longitudinal wires advance step-wise, a second feed assembly able to arrange at least one transverse wire at a time in a first preparation position, a positioning apparatus able to remove the transverse wire from the first preparation position and to arrange it in a second, pre-determined attachment position, and a welding assembly by means of which the transverse wires and the longitudinal wires are attached to each other.

The positioning apparatus comprises at least a loading assembly, preferentially two or more, arranged aligned along the transverse wire, including a gripping and transfer device provided with a prehensile member able to grip at least one transverse wire at a time in order to locate it in the second attachment position.

According to the invention, the positioning apparatus is provided with thrust means by means of which the transverse wire is taken from the first preparation position to a third intermediate position, advantageously near the second attachment position wherein it is picked up by the gripping and transfer device.

In a preferential form of embodiment, the prehensile member consists of at least a gripper, provided with jaws which can be opened elastically, associated with relative movement means able to take it cyclically from the third intermediate position to the second attachment position and vice versa.

In one embodiment of the invention, the thrust means comprise at least a rotary element provided with blade means able to thrust the transverse wire from the first preparation position to the third intermediate pick-up position.

According to the invention, a transverse wire is moved by the thrust means from the first preparation position to the third intermediate pick-up position while the prehensile member of the gripping and transfer device, which has taken the previous wire to the second attachment position, moves back, from the second attachment position to the third intermediate pick-up position.

In this way the third intermediate position is reached substantially simultaneously, due to the reciprocal approach of the transverse wire and the prehensile member.

Moreover, at the same time that the wire is picked up from said third intermediate position, a second transverse wire is arranged in the first preparation position so that, once the first wire is taken to the second position, a second wire is already ready to be taken from the first to the third position.

The use of thrust means therefore allows to limit the travel of the prehensile member and to speed up the times required to insert the wires, thus reducing the downtimes of the machine due to the positioning of the transverse wires, with a considerable advantage in terms of productivity.

According to a variant, the loading assembly of the machine according to the invention comprises a retaining device defining an insertion seating, made in the first preparation position, wherein the transverse wire is fed by the relative feed assembly.

The retaining assembly comprises two jaws which, in the closed condition, define the insertion seating, while in the open condition they release the transverse wire, allowing it to move from the first preparation position to the third intermediate pick-up position.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL EMBODIMENT

With reference to the attached figures, the number 10 denotes generally a machine for the formation of metal wire mesh 11 according to the present invention.

Figure 1:
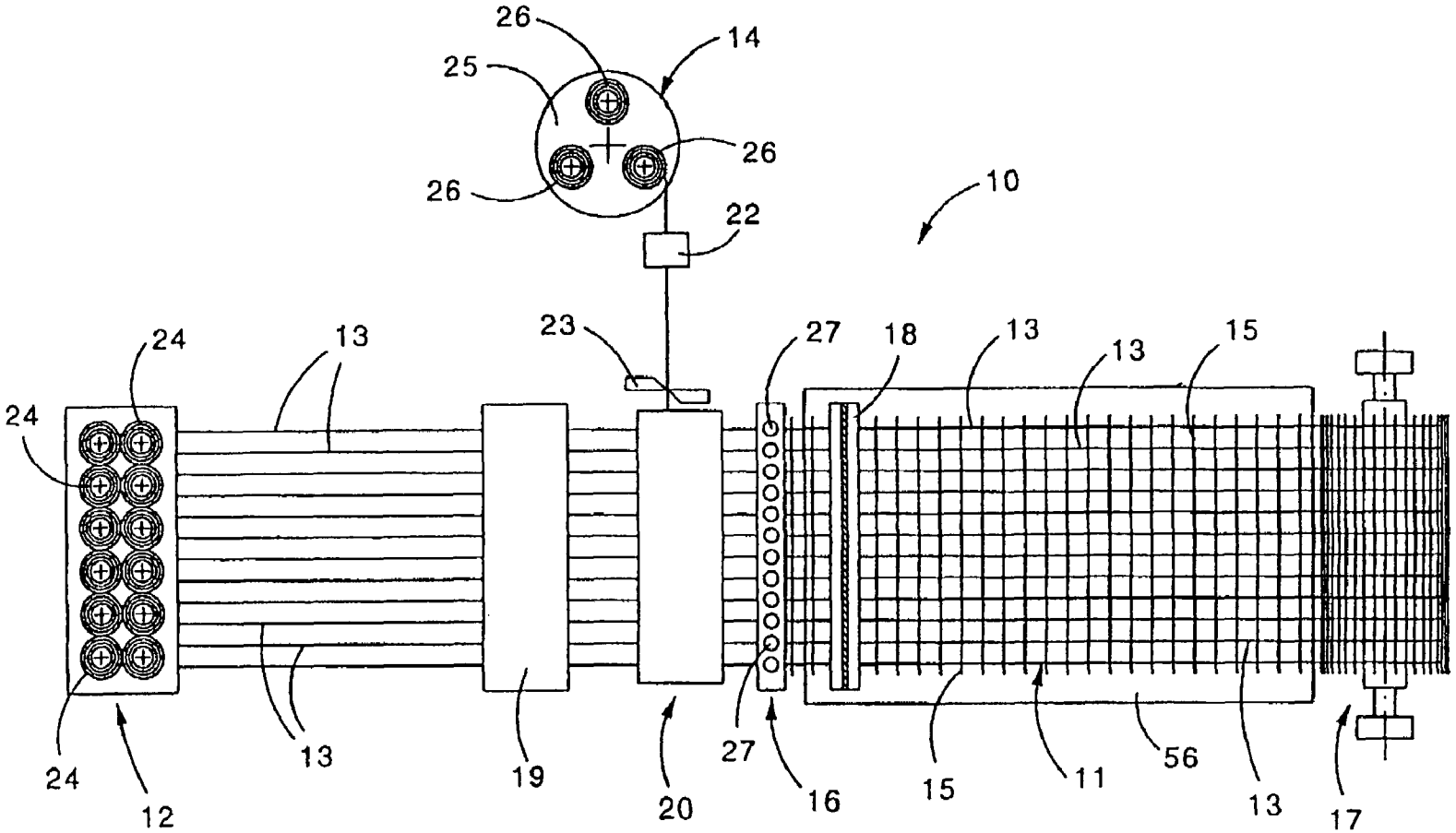
FIG. 1 is a schematic plane view of a machine for the formation of a metal wire mesh according to the invention.

The machine 10 substantially comprises: a feed and advance assembly 12 for the longitudinal wires 13, a feed assembly 14 and a positioning apparatus 20 for transverse wires 15, a welding assembly 16, a shears 18 to shear the mesh 11 into sheets and a winding drum 17 onto which the mesh 11 can be wound in a coil (FIG. 1).

The drum 17 and the shears 18 can be present and/or operating alternately with each other.

Figure 6:
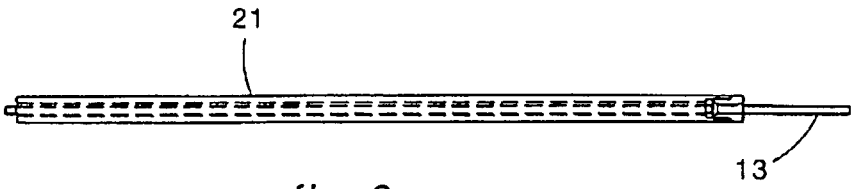
FIG. 6 shows a pipe of the feed assembly of the longitudinal wires of the machine according to the invention.
Figure 7:
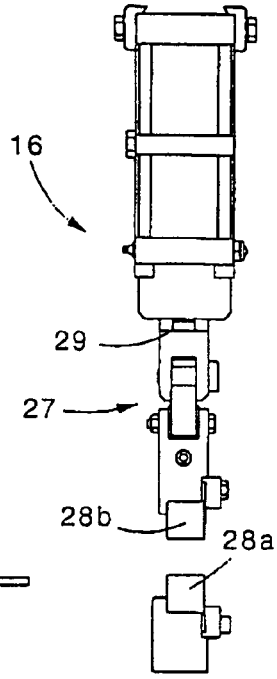
FIG. 7 is a side view of the welding assembly of the machine according to the invention.

The feed and advance assembly 12 comprises a plurality of reels 24 from which the longitudinal wires 13 are unwound; in this case, the longitudinal wires 13 are subjected to straightening by a first straightening device 19 and then made to advance towards the welding assembly 16 through respective guide conduits 21 (FIG. 6).

The feed assembly 14 in this case comprises a carousel 25 on which three reels 26 are mounted, from which, in succession, the transverse wire 15 is unwound.

In this case, the transverse wire 15 is straightened through the second straightening device 22 and then sheared to size by means of a shears 23 according to the width of the mesh 11 to be made.

The welding assembly 16 consists of a plurality of electric welders 27 arranged parallel, each of which is suitable to weld a relative longitudinal wire 13 to the transverse wires 15 which on each occasion are fed.

Each welder 27 (FIGS. 7–16) comprises a fixed lower electrode 28*a* and an upper electrode 28*b*, mounted on a vertical actuator 29, able to close on the lower electrode 28*a* in order to perform the welding.

The positioning apparatus 20 consists of a plurality of loading assemblies 30, for example from two to ten in number according to the width of the mesh 11 to be made, arranged aligned parallel to the axis of feed of the transverse wires 15 and able to operate simultaneously.

Each of the loading assemblies 30 comprises a gripping and transfer device 31, a retaining device 32 and a thrust member 33, which act in coordination with each other and in cooperation with a stop element 34.

Figure 3:
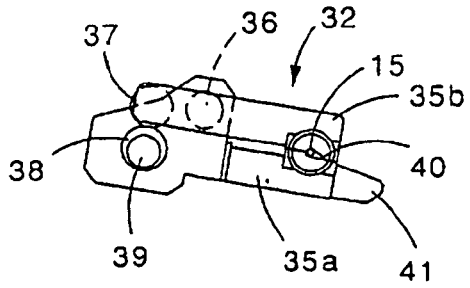

The retaining device 32 (FIG. 3) consists of two jaws: a fixed lower jaw 35*a* and a movable upper jaw 35*b*.

To be more exact, the upper jaw 35*b* is hinged by means of a pin 36 onto the lower jaw 35*a* and has an abutment element 37 located in contact with an eccentric 38 mounted on a shaft 39; the rotation of the shaft 39 causes the eccentric 38 to slide on the abutment element 37 and hence a cyclic oscillation of the upper jaw 35*b* from an open position to a closed position on the lower jaw 35*a* and vice versa.

In the closed position, the two jaws 35*a* and 35*b* define a wedge-shaped insertion seating 40, located on the axis of feed of the transverse wire 15, inside which the latter is received and retained. In the open position, on the contrary, the transverse wire 15 is released and, as will be described hereafter, made to slide along an appendix 41, inclined downwards, of the lower jaw 35*a*.

Figure 2:
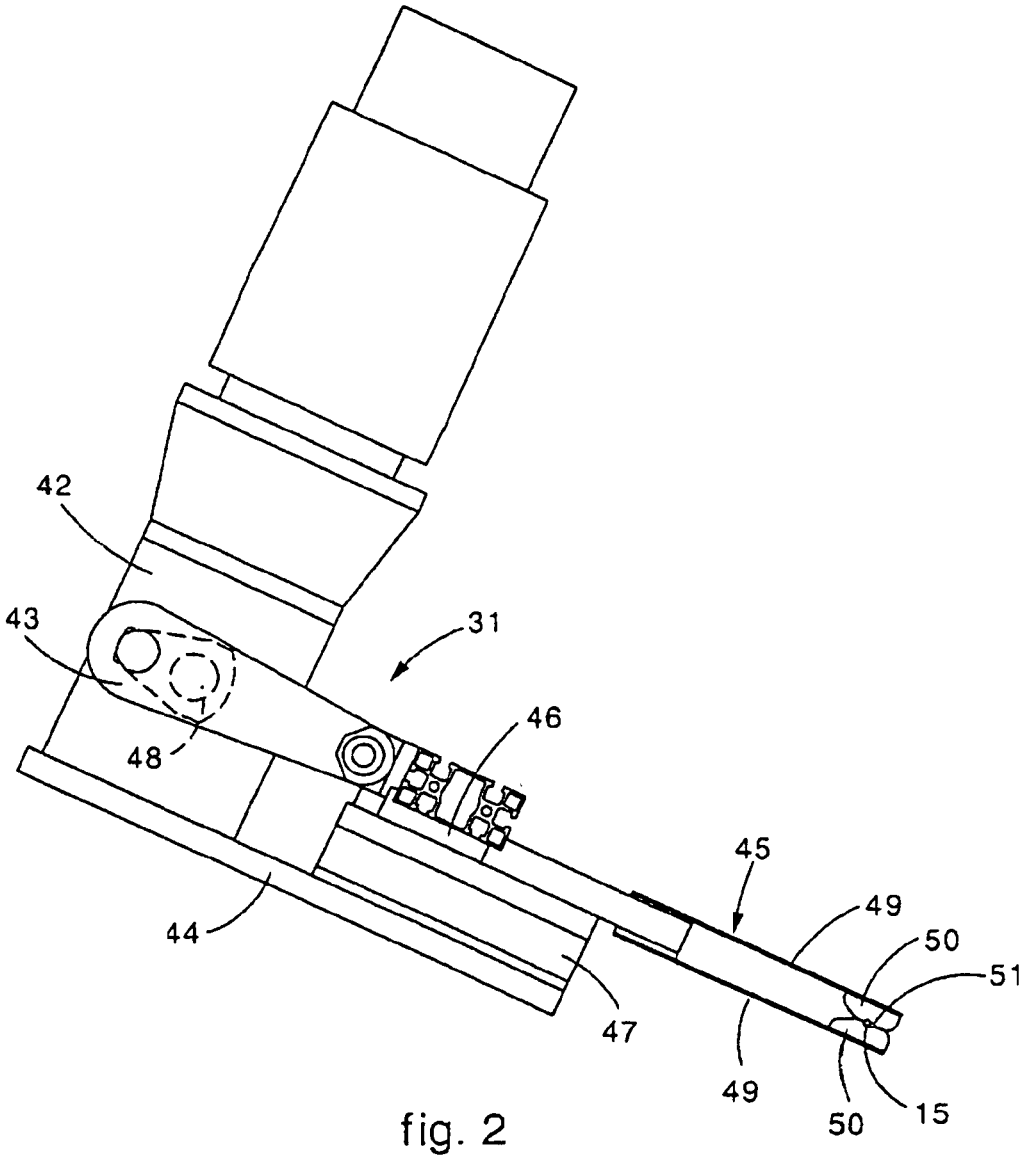
FIGS. 2–5 show a side view of the devices of a loading assembly of the positioning apparatus of the transverse wires of the machine according to the invention.

The gripping and transfer device 31 comprises a support 42 on which a rod 43 is mounted, and an elastic gripper 45 mounted on a slider 46 by means of which the transverse wires 15 are located in the position wherein they are attached to the longitudinal wires 13; the slider 46 is able to slide on guides 47, attached to an inclined bracket 44 solid with the support 42, and is hinged at one end of the rod 43 (FIG. 2).

According to a variant, not shown in the drawings, the slider 46 is made to slide by a linear actuator commanded by electronic devices of a conventional type, such as a PLC or suchlike.

The elastic gripper 45 comprises two flexible foils 49 on which two shaped jaws 50 are attached; in normal conditions, the two foils 49 are kept parallel to each other and the shaped jaws 50 are closed, defining a housing seating 51 for a transverse wire 15.

The rotation of the shaft 48 which drives the rod 43 determines a cyclical movement of the slider 46 which takes the elastic gripper 45 from a retracted position, cooperating with the retaining device 32, to a forward position wherein it lies on the same plane as the welding assembly 16, but in a laterally displaced position with respect to the electrodes 28*a* and 28*b*.

During this movement, when there is a transverse wire 15 interfering front-wise or rear-wise with the shaped jaws 50, the latter first open, in order to open the flexible foils 49 and allow the transverse wire 15 to enter the housing seating 51, then elastically close again.

In the same way, during the cyclical movement of the elastic gripper 45, if the transverse wire 15 located inside the housing seating 51 is retained, the shaped jaws 50 first open, allowing the transverse wire 15 to exit, and then elastically close again.

The entry and exit of the transverse wire 15 to/from the housing seating 51 are facilitated by the presence of lead-in surfaces, converging and partly curved, made front-wise and rear-wise on the shaped jaws 50 on which the transverse wire 15 slides.

Figure 4:
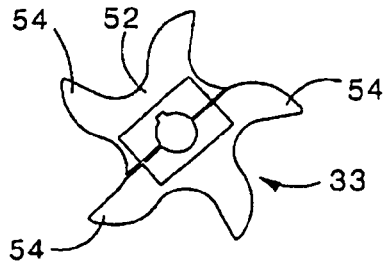
Figure 5:
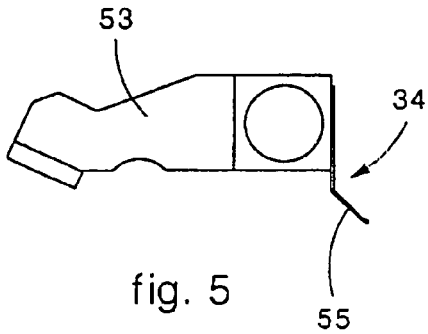

The thrust member 33 (FIG. 4) consists of a rotary disc 52, mounted on an arm 53 (FIG. 5) solid with the inclined bracket 44, in a lateral position with respect to the retaining device 32. The stop element 34, in this case consisting of a platelet 55, advantageously of the elastic type, is also attached to the arm 53; the lower end of the platelet 55 is located near the appendix 41 of the lower jaw 35*a*.

The disc 52 is provided with blades, or fins, 54 by means of which it is able to thrust the transverse wires 15 outside the insertion seating 40 of the retaining device 32, making it slide along the appendix 41 where it is retained by the platelet 55.

As already explained, the devices 31, 32 and 33 of the positioning apparatus 20 for the transverse wires 15 operate in coordinated fashion with each other and are advantageously managed by a command and control assembly in common with the other operating assemblies of the machine 10.

The functioning of the machine 10 according to the invention provides that, with every advance step of the longitudinal wires 13, a transverse wire 15, fed by the feed assembly 14 and sheared to size by the shears 23, after having been straightened by the second straightening device 22, is made to reach the positioning apparatus 20 so as to be located on the same plane on which the welding assembly 16 lies and to be attached to the longitudinal wires 13.

In this way the mesh 11 is gradually formed on a supporting plane 56 and can be alternately either sheared into sheets by means of the shears 18, or wound into coils by means of the winding drum 17.

With the aid of FIGS. 8–16 we shall now describe in detail the functioning of the positioning apparatus 20; the description refers to a single loading assembly 30, but it is understood that all the loading assemblies 30 of the positioning apparatus 20 operate simultaneously with each other and in the same way; advantageously there is a single drive shaft 48 for all the rods 43, a single shaft 39 for all the eccentrics 38 and a single shaft suitable to make all the discs 52 rotate.

Figure 8:
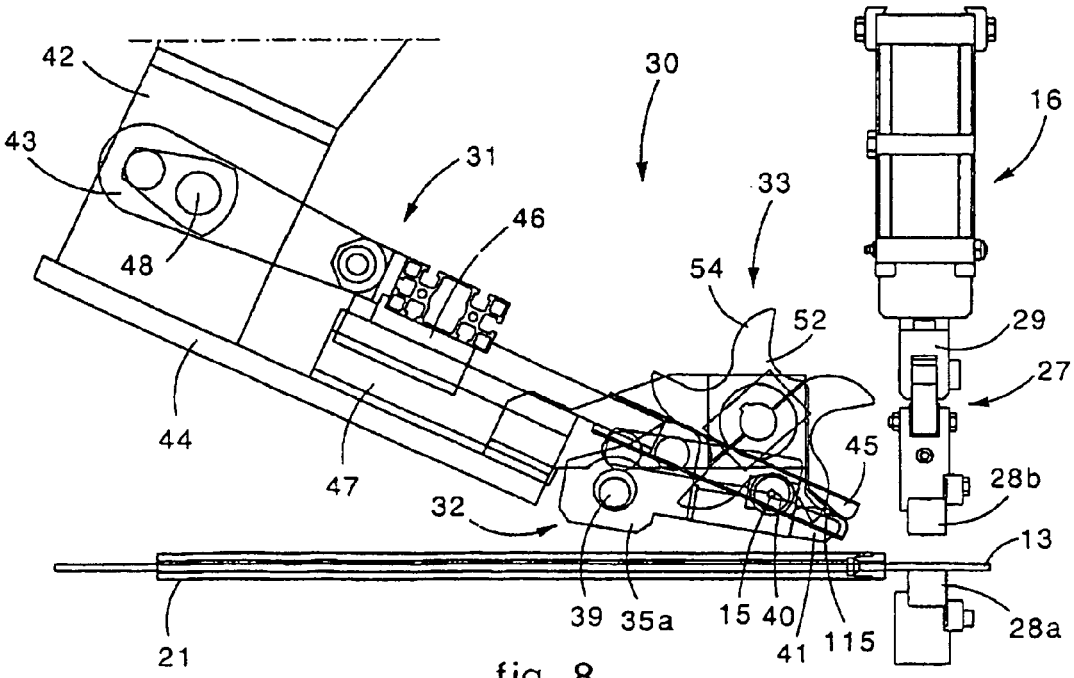
FIGS. 8–16 show the operative steps of the apparatus to position the transverse wires of the machine according to the invention.

The transverse wire 15, fed by the feed assembly 14, is initially introduced into the insertion seating 40 of the retaining device 32, in a first position where it is prepared to be picked up, while a previously fed transverse wire 115 is moved towards the welding assembly 16 by the elastic gripper 45 of the gripping and transfer device 31 (FIG. 8).

In this step, the upper jaw 35*b* is in its closed position on the lower jaw 35*a*, the slider 46 is in a completely retracted position and the blades 54 of the disc 52 do not interfere with the transverse wire 15. Moreover, the elastic gripper 45 is in a position such that it does not interfere with the transverse wire 15 which therefore can be introduced between the flexible foils 49.

Figure 9:
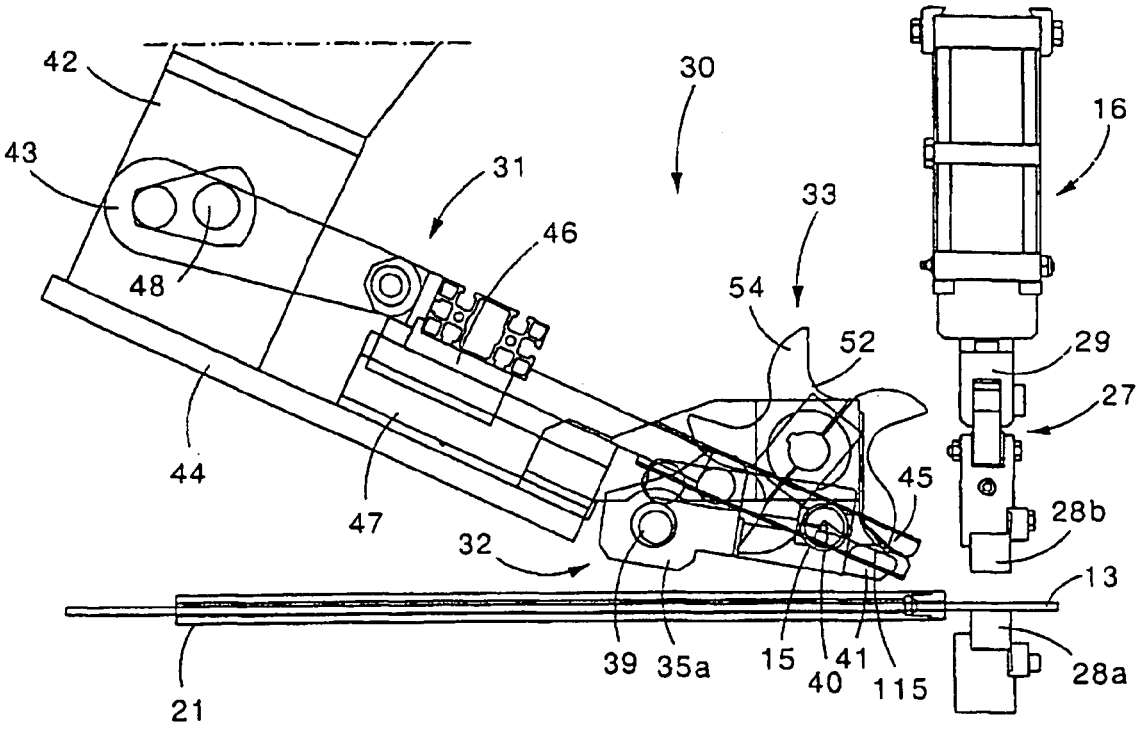
Figure 10:
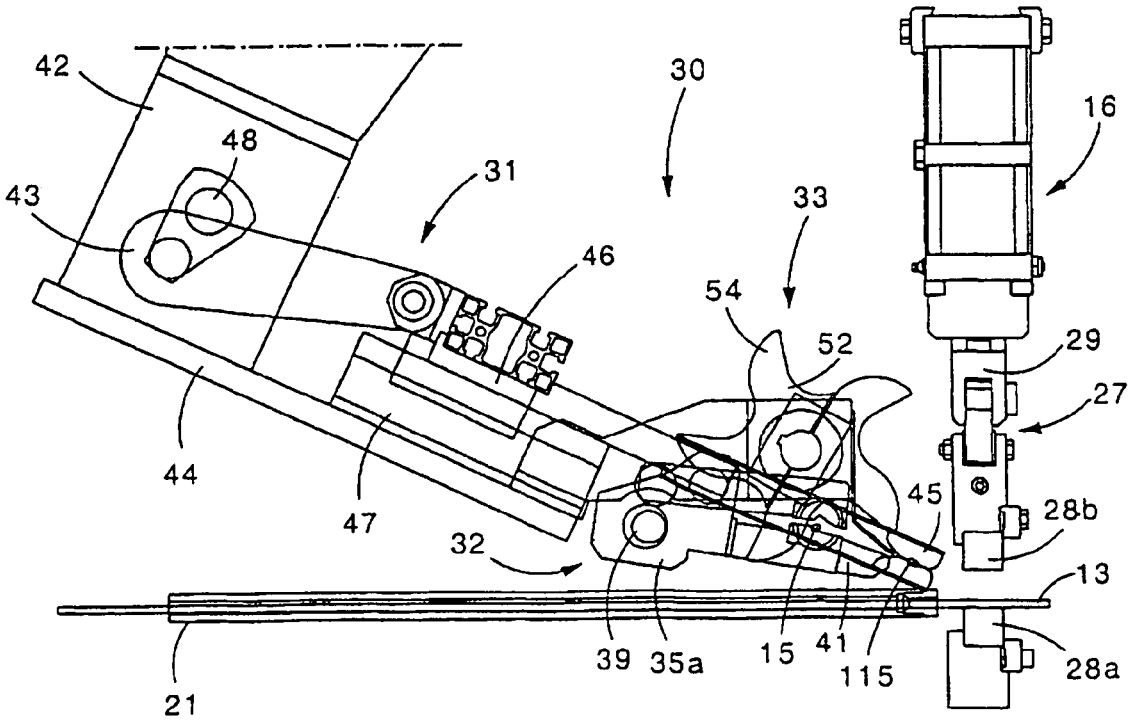
Figure 11:
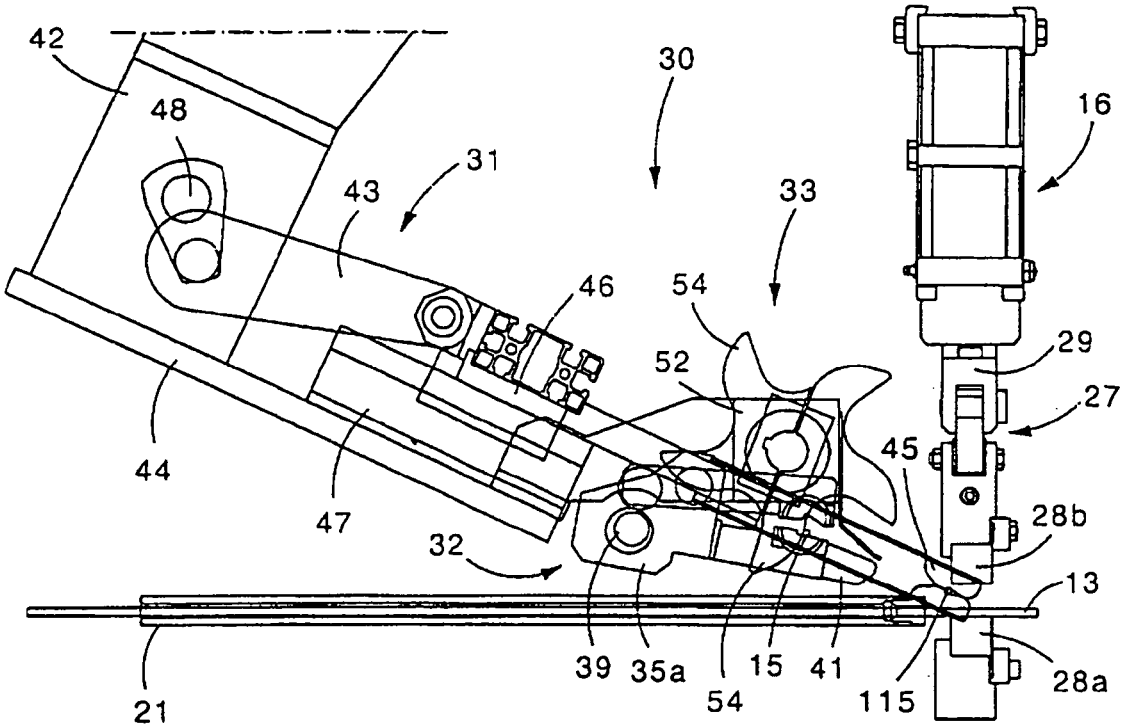

Subsequently, the rotation of the drive shaft 48 for the rod 43, and that of the shaft 39 of the eccentric 38, respectively determine a progressive advance of the slider 46, and hence of the elastic gripper 45, towards the welding assembly 16, and the gradual opening of the upper jaw 35*b*; in this step the disc 52 rotates slightly, but the blades 54 thereof do not interfere with the transverse wire 15 (FIGS. 9 and 10).

Figure 12:
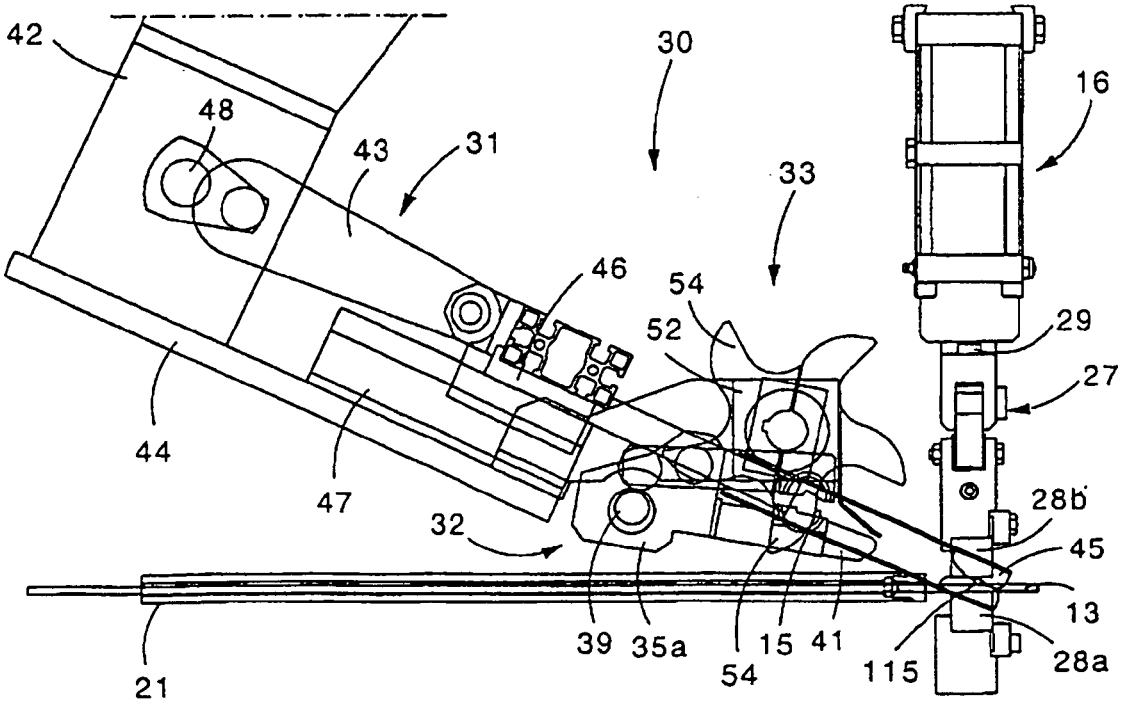

Continuing its rotation, the shaft 48 causes the elastic gripper 45 to approach the welding assembly 16 (FIG. 11) until the transverse wire 115 is arranged in the position wherein it is attached to the longitudinal wires 13 (FIG. 12).

At the same time, the rotation of the shaft 39 takes the upper jaw 35*b* to a position of complete opening while the blades 54 of the disc 52 start to thrust the transverse wire 15 towards the appendix 41 of the lower jaw 35*a*.

Figure 13:
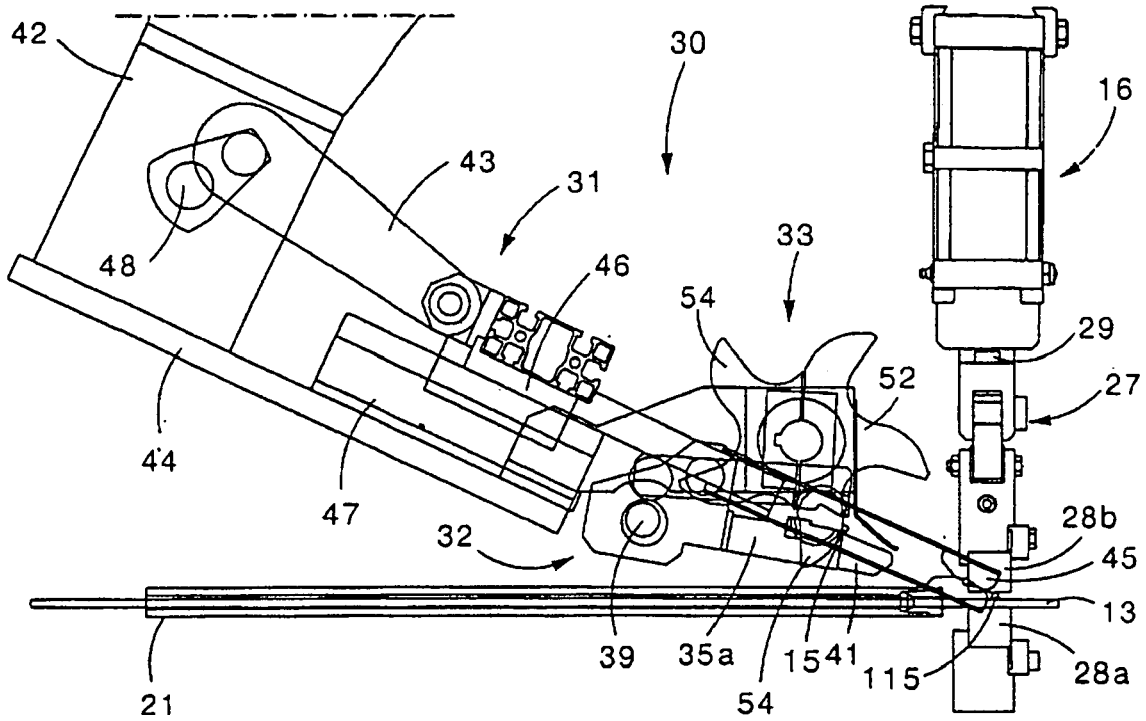
Figure 14:
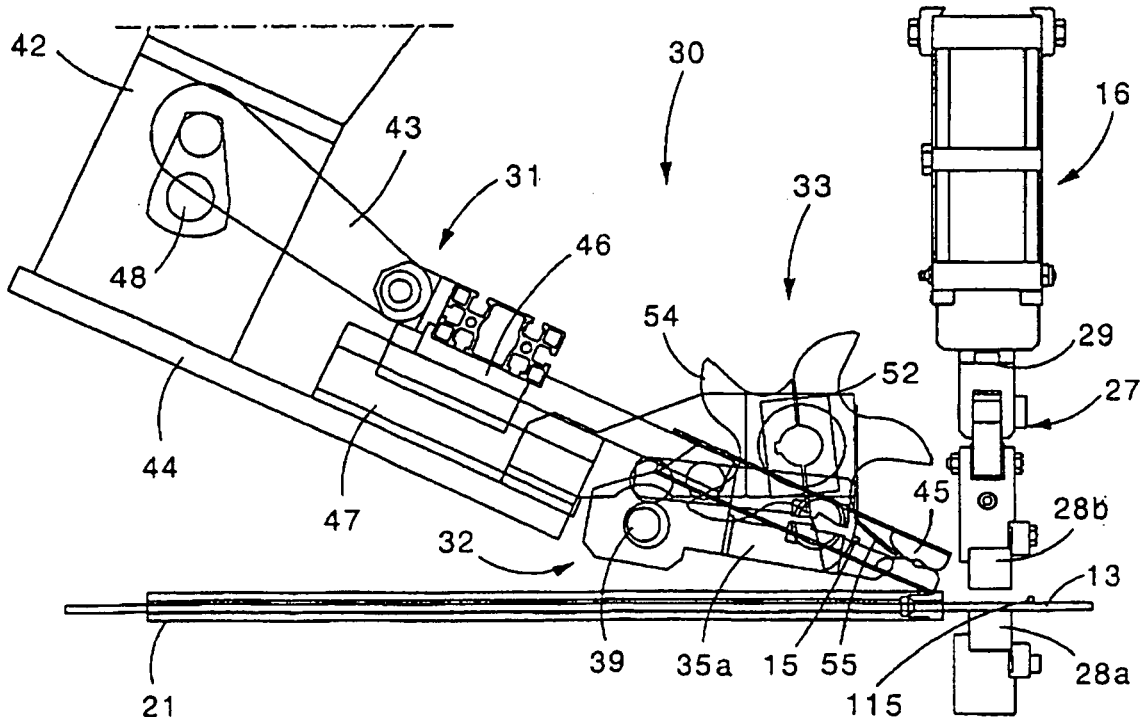
Figure 15:
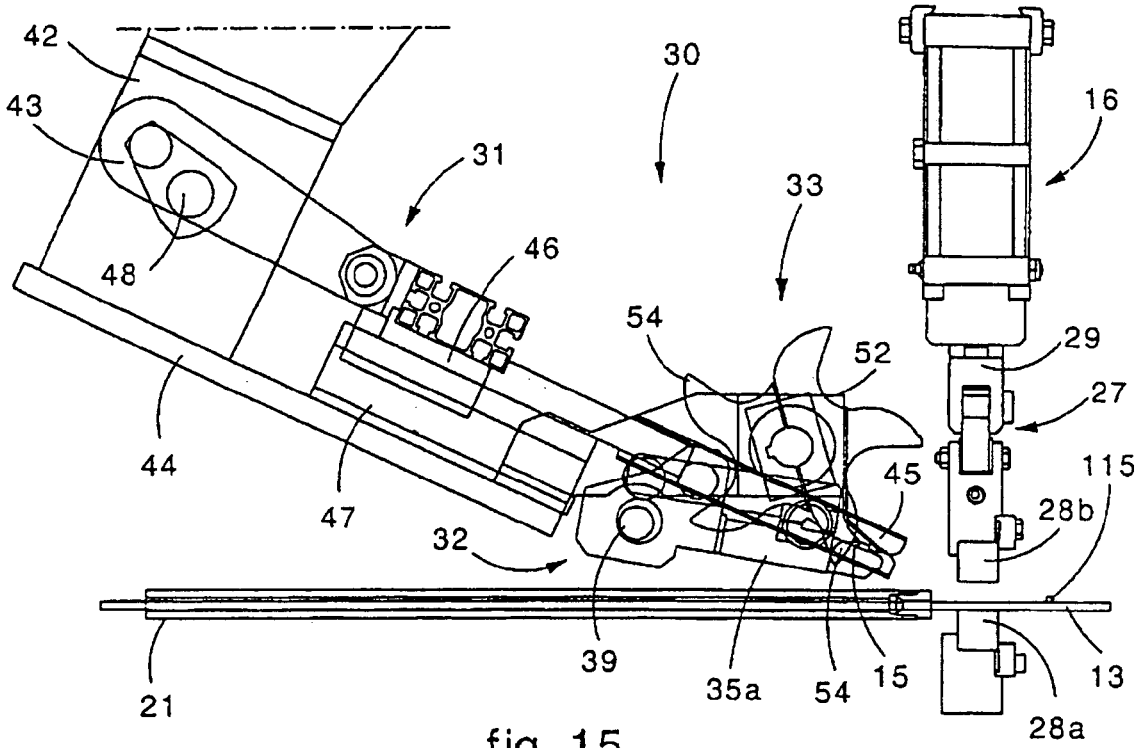
Figure 16:
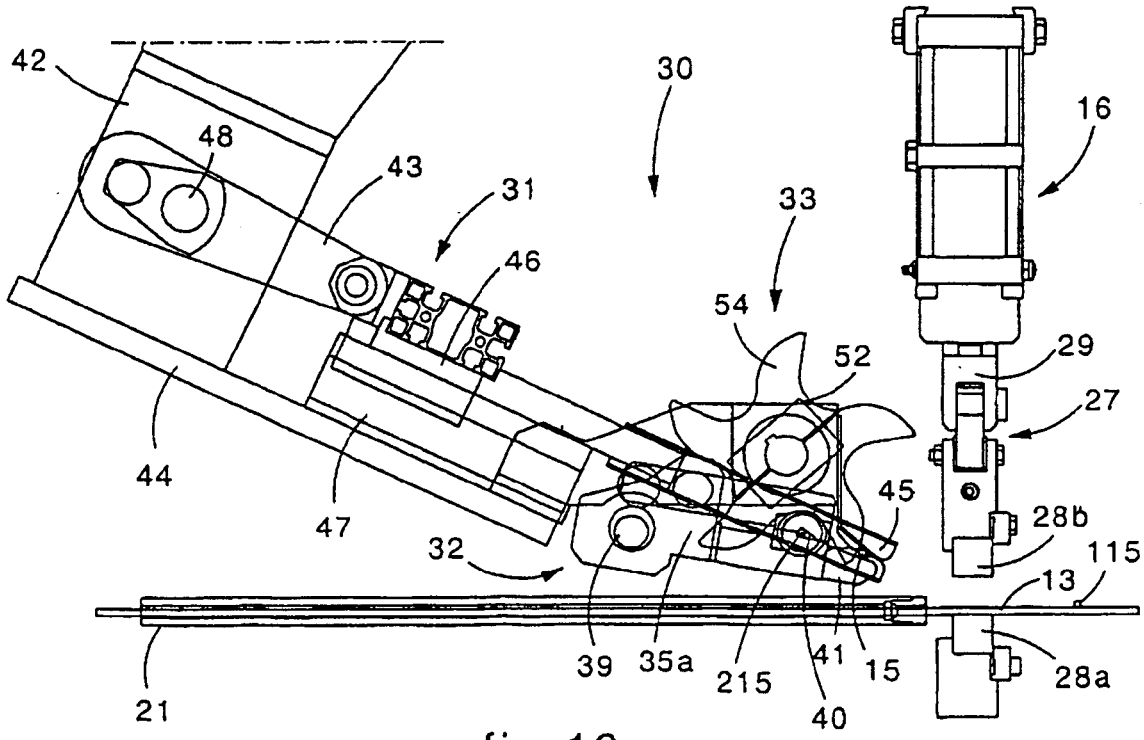

Once the transverse wire 115 has been attached to the longitudinal wires 13, the elastic gripper 45 retreats, since it is retracted by the rod 43, opening and releasing itself from the transverse wire 115 (FIG. 13).

At the same time the upper jaw 35*b* progressively begins to close again, while the blade 54 of the disc 52 continues to thrust the transverse wire 15 along the appendix 41 of the lower jaw 35*a* (FIG. 14) on which it is retained by the platelet 55.

Moreover, the longitudinal wires 13 are made to advance by a step equal to the interaxis between the transverse wires 15 of the mesh 11.

In this step, there is a reciprocal drawing near of the elastic gripper 45 and the transverse wire 15, which continues to be thrust by the blade 54 of the disc 52.

Continuing to retreat, the elastic gripper 45 comes into contact with the transverse wire 15 (FIG. 15) and, due to the thrust exerted on the latter by the blade 54, it opens, allowing the transverse wire 15 to be inserted into the relative housing seating 51; the stop element 34 retains the transverse wire 15, preventing the thrust exerted by the blade 54 from making it exit frontally from the elastic gripper 45.

This happens when the elastic gripper 45 has reached the completely retreated position (FIG. 16), while the upper jaw 35*b* closes on the lower jaw 35*a*, allowing a new transverse wire 215 to be introduced into the insertion seating 40.

Subsequently the transverse wire 15 is taken to the attachment position between the two electrodes 28*a* and 28*b* in order to be attached to the longitudinal wires 13, while the transverse wire 215 is progressively moved as described previously, until it is picked up by the elastic gripper 45, and the process continues for all the other transverse wires 15.

The cycle of positioning the transverse wires 15 as described occurs in an extremely short time, due to the presence of the thrust member 33 which allows the reciprocal approach of the transverse wire 15 which has to be taken from the preparation position, and the elastic gripper 45 which picks up the transverse wire 15 and locates it in the attachment position.

This allows to considerably reduce the downtimes of the machine 10 during the steps of feeding and positioning the transverse wires 15, notably increasing productivity.

It is clear, however, that modifications and/or additions of parts may be made to the machine 10 for the formation of mesh as described heretofore and the relative method, without departing from the field and scope of the present invention.

For example, the systems to move the elastic gripper 45 of the gripping and transfer device 31 or the upper jaw 35*b* of the retaining device can be achieved by means of fluid-dynamic, mechanical or other types of actuators.

Or the thrust member 33 can consist of any functionally equivalent means.

Furthermore, the feed assembly 14 could be configured in a different way and/or provide to feed transverse wires 15 which are pre-sheared to size.

According to another variant, there may be a second loading assembly 30 provided, located specular to the first with respect to the longitudinal axis of the wires 13, so as to be able to make two metal meshes 11 simultaneously, one having the transverse wires 15 welded above the longitudinal wires 13, and the other having the transverse wires 15 welded below the longitudinal wires 13. In this way it is not necessary to use, downstream of the machine 10, a possible overturning device which is normally provided, during the storage step, to reduce the thickness in bulk of the meshes 11 made.

Moreover, although the present invention has been described with reference to specific examples, a person of skill in the art shall certainly be able to achieve many other equivalent forms of machine and perfect analogous methods for the formation of metal wire mesh, all of which shall come within the field of the present invention.

The invention claimed is:

1. Machine for the formation of metal mesh made of metal wires obtained by attaching together a plurality of longitudinal metal wires to a plurality of transverse metal wires, said machine comprising at least:

a first feed assembly able to make said longitudinal wires advance step-wise, a second feed assembly able to arrange at least one transverse wire at a time in a first preparation position, a positioning apparatus able to arrange said transverse wire in a second attachment position, and a welding assembly able to attach said transverse wires to said longitudinal wires, said positioning apparatus comprising at least a loading assembly comprising a gripping and transfer device, able to locate said transverse wire in said second attachment position, and thrust means able to take said transverse wire from said first preparation position to a third intermediate pick-up position, near said second attachment position, wherein said transverse wire is picked up by said gripping and transfer device, said thrust means comprising at least a rotary element provided with blade means able to thrust the transverse wire from said first preparation position to said third intermediate pick-up position, wherein said loading assembly comprises a retaining device, wherein said retaining device comprises two jaws of which at least one is cyclically movable from a closed position, wherein said movable jaw defines with the other jaw an insertion seating, to an open position wherein said transverse wire is released to be taken to said third intermediate pick-up position, and wherein said movable jaw is hinged on the other jaw and has an abutment element cooperating with eccentric means made to rotate by a shaft, the rotation of said eccentric means causing the cyclic movement of said movable jaw from said closed position to said open position and vice versa.

2. Machine as in claim 1, wherein said gripping and transfer device comprises at least a prehensile member associated with relative movement means able to take said prehensile member cyclically from said third intermediate pick-up position to said second attachment position and vice versa.

3. Machine as in claim 1, wherein said jaws are shaped with lead-in surfaces, converging and at least partly curved, on which said transverse wires are able to slide to be inserted into and emerge from said housing seating.

4. Machine for the formation of metal mesh made of metal wires obtained by attaching together a plurality of longitudinal metal wires to a plurality of transverse metal wires, said machine comprising at least:

a first feed assembly able to make said longitudinal wires advance step-wise, a second feed assembly able to arrange at least one transverse wire at a time in a first preparation position, a positioning apparatus able to arrange said transverse wire in a second attachment position, and a welding assembly able to attach said transverse wires to said longitudinal wires, said positioning apparatus comprising at least a loading assembly comprising a gripping and transfer device, able to locate said transverse wire in said second attachment position, and thrust means able to take said transverse wire from said first preparation position to a third intermediate pick-up position, near said second attachment position, wherein said transverse wire is picked up by said gripping and transfer device, said thrust means comprising at least a rotary element provided with blade means able to thrust the transverse wire from said first preparation position to said third intermediate pick-up position, wherein said loading assembly comprises a retaining device defining an insertion seating, made in said first preparation position, wherein said transverse wire is fed by said second feed assembly, wherein said retaining device comprises two jaws of which at least one is cyclically movable from a closed position, wherein said movable jaw defines with the other jaw said insertion seating to an open position wherein said transverse wire is released to be taken to said third intermediate pick-up position, and wherein said movable jaw is hinged on the other jaw and has an abutment element cooperating with eccentric means made to rotate by a shaft, the rotation of said eccentric means causing the cyclic movement of said movable jaw from said closed position to said open position and vice versa.

5. Machine as in claim 4, wherein said thrust means are able to thrust said transverse wire from said first preparation position to said third intermediate pick-up position along a sliding surface.

6. Machine as in claim 5, wherein said loading assembly comprises a stop element able to cooperate with said sliding surface to keep said transverse wire on said surface.

7. Machine for the formation of metal mesh made of metal wires obtained by attaching together a plurality of longitudinal metal wires to a plurality of transverse metal wires, said machine comprising at least:

a first feed assembly able to make said longitudinal wires advance step-wise, a second feed assembly able to arrange at least one transverse wire at a time in a first preparation position, a positioning apparatus able to arrange said transverse wire in a second attachment position, and a welding assembly able to attach said transverse wires to said longitudinal wires, said positioning apparatus comprising at least a loading assembly comprising a gripping and transfer device, able to locate said transverse wire in said second attachment position, and thrust means able to take said transverse wire from said first preparation position to a third intermediate pick-up position, near said second attachment position, wherein said transverse wire is picked up by said gripping and transfer device, said thrust means comprising at least a rotary element provided with blade means able to thrust the transverse wire from said first preparation position to said third intermediate pick-up position, wherein said gripping and transfer device comprises at least a prehensile member associated with relative movement means able to take said prehensile member cyclically from said third intermediate pick-up position to said second attachment position and vice versa, and wherein said prehensile member comprises a gripper with two jaws able to open and close elastically, said jaws defining, in their closed condition, a housing seating for said transverse wires.

8. Machine as in claim 7, wherein said loading assembly comprises a retaining device defining an insertion seating, made in said first preparation position, wherein said transverse wire is fed by said second feed assembly.

9. Machine as in claim 7, wherein said movement means comprise a rod driven by a relative shaft and connected to slider means sliding on guides and associated with said prehensile member.

10. Machine as in claim 7, wherein said jaws are shaped with lead-in surfaces, converging and at least partly curved, on which said transverse wires are able to slide to be inserted into and emerge from said housing seating.

11. Machine as in claim 7, wherein, when said gripper is in said third intermediate pick-up position, said blade means are able to cause said jaws to open due to the effect of the thrust exerted on said transverse wire, allowing said transverse wire to be inserted into said housing seating.

12. Machine as in claim 11, wherein said loading assembly comprises a stop element able to retain said transverse wire at least during the step of insertion into said housing seating, preventing said transverse wire from emerging due to the effect of an excessive thrust by said blade means.

13. Machine as in claim 7, wherein at least one of said jaws is moveable and the rotation of said rotary element and the cyclical movement of said prehensile member and of said movable jaw are managed by a command and control assembly which coordinates them according to at least the drive of said welding assembly.

14. Loading assembly for at least a first metal wire, fed in a first preparation position, to be attached to at least a second metal wire in a second attachment position, comprising:

movement means able to take said first wire from said first preparation position to said second attachment position, wherein said movement means comprise at least a gripping and transfer device, able to grip said first wire to locate said first wire in said second attachment position, and thrust means able to take said first wire from said first preparation position to a third intermediate pick-up position wherein said first wire is picked up by said gripping and transfer devices, wherein said loading assembly comprises a retaining device, wherein said retaining device comprises two jaws of which at least one is cyclically movable from a closed position, wherein said movable jaw defines with the other jaw an insertion seating, to an open position wherein said transverse wire is released to be taken to said third intermediate pick-up position, and wherein said movable jaw is hinged on the other jaw and has an abutment element cooperating with eccentric means made to rotate by a shaft, the rotation of said eccentric means causing the cyclic movement of said movable jaw from said closed position to said open position and vice versa.

15. Loading assembly for at least a first metal wire, fed in a first preparation position, to be attached to at least a second metal wire in a second attachment position, comprising:

movement means able to take said first wire from said first preparation position to said second attachment position, wherein said movement means comprise at least a gripping and transfer device, able to grip said first wire to locate said first wire in said second attachment position, and thrust means able to take said first wire from said first preparation position to a third intermediate pick-up position wherein said first wire is picked up by said gripping and transfer device, wherein said gripping and transfer device comprises at least a prehensile member associated with relative movement means able to take said prehensile member cyclically from said third intermediate pick-up position to said second attachment position and vice versa, and wherein said prehensile member comprises a gripper with two jaws able to open and close elastically, said jaws defining, in their closed condition, a housing seating for said transverse wires.

* * * * *